United States Patent [19]

Lewy

[11] Patent Number: 4,922,940

[45] Date of Patent: May 8, 1990

[54] INVALID WALKER

[76] Inventor: Michael M. Lewy, R.D. #1, Box 849, Priddle Point Rd., Gloversville, N.Y. 12078

[21] Appl. No.: 386,597

[22] Filed: Jul. 31, 1989

[51] Int. Cl.[5] ..... A61H 3/00

[52] U.S. Cl. ..... 135/67; 135/74

[58] Field of Search ..... 135/67, 74

[56] References Cited

U.S. PATENT DOCUMENTS

| | | | |
|---|---|---|---|
| 2,362,466 | 11/1944 | Carter | 135/67 |
| 2,634,790 | 4/1953 | Elle | 135/67 |
| 3,176,700 | 4/1965 | Drury, Jr. | 135/45 |
| 3,455,313 | 7/1969 | King | 135/45 |
| 3,516,425 | 6/1970 | Migal | 135/67 |
| 3,800,815 | 4/1974 | Birk | 135/67 |
| 4,314,576 | 2/1982 | McGee | 135/67 |
| 4,411,283 | 10/1983 | Lucarelli | 135/67 |
| 4,532,948 | 8/1985 | Barrows | 135/67 |
| 4,830,035 | 5/1989 | Liu | 135/67 |

*Primary Examiner*—Henry E. Raduazo

*Attorney, Agent, or Firm*—Heslin & Rothenberg

[57] ABSTRACT

An improved walking assistance device which is also specifically adapted for traversing stairs comprises a rigid intertwined open framework supported by a front and rear pair of legs which permit the device to span multi steps in a stairway. The open framework includes forwardly extending arm rails parallel to the slope of the stairs. Other arm rails support a sling seat for the user person. The device is fitted with appropriate hinges for folding reduction in overall size for more convenient portability.

8 Claims, 3 Drawing Sheets

INVALID WALKER

BACKGROUND OF THE INVENTION

This invention relates to an improved invalid walker, and more particularly, to an improved invalid walker specially adapted for continuous positive operator assistance and security in ascending and descending flights of stairs.

Various walker assistance devices are commercially available for those physically handicapped persons having muscle weakness and/or lack of full muscle control which seriously affect normal walking motions and bodily balance. Such physically handicapped persons face a number of problems associated with the following normal walking and closely related activities.

1. Acquiring gait, balance and muscular control in walking.
2. Changing from walking over a level surface to ascending steps.
3. Changing from walking over a level surface to descending steps.
4. Changing from ascending stairs to a level surface.
5. Chaning from descending stairs to a level surface.
6. Traversing stairs upwardly and downwardly.
7. Resting.

Walking as described means ambulation over a planar horizontal surface, i.e., a level surface as well as traversing plural upwardly or downwardly directed steps. Each of the above activities requires a significantly different grip, balance point, center of gravity, and angle of attack.

In general, prior walker devices include a high strength, but light weight, floor supporting cage-like frame which partly surrounds and is carried by the invalid or user person. For each one or more steps the user takes, the walker is lifted from the floor and repositioned on the walking surface a short distance in the direction the user is moving and in advance of taking additional steps. Such walkers have also been modified for improved use in ascending and descending steps and stairs. U.S. Pat. No. 3,800,815 - Birk 3/2/74 is an example of such a walker. For use in ascending and descending stairs the Birk walker, which utilizes four leg supports, one at each corner of an upstanding open-sided rectangular framework, includes a lengthening adjustment for a front pair or rear pair of legs. As a result, the front legs may be supported by one of a series of steps, while the rear legs may be supported by an adjacent step at a different level, and the walker frame structure remains vertical on the stairs for better balance of the using person. The fact that the walker remains in a vertical position represents a problem for some users. When the walker is placed on a further upper and adjacent step, the user may inadvertently reach or need to reach, forwardly and upwardly and use the walker for balance and possibly for some combined downwardly and inwardly pulling effort. When the walker resides on steps of different elevations an inadvertent pull may be a dangerously unbalancing occurance in spite of the fact that the walker may be firmly vertically balanced by the adjustable legs. Such an adjustment which merely maintains the original distance between the front and rear legs does not increase the force necessary to topple the walker. Furthermore, when such a walker is placed on an adjacent higher step, the walker cage arms are significantly elevated with respect to a person on a lower step and in an awkward position for safe and effective support of the user. These and other typical disadvantages are found in other prior art walkers. Further examples of prior art walkers similar to the above noted Birk walker are disclosed and described in U.S. Pats. No 3,455,313 - King 7/15/69, 4,411,283 - Lucarelli 10/25/83 and 3,176,700 - Drury, Jr. 4/6/65.

The present invention not only provides a much improved walker structure specifically directed to the above noted problems as well as other disadvantages, but also recognizes that a physically handicapped person ordinarily needs continuity and certainty of balance and security in a walking assistance device.

SUMMARY OF THE INVENTION

A walker for ambulatory assistance particularly for stairways comprises a multiple step spanning, four leg supporting framework which spans a plurality, two or more steps, while providing extending arm or hand rails projecting from the walker in one direction for each arm of the user. The hand rails remain in parallel to the stair path.

This invention will be better understood when taken in connection with the following description and drawings.

DESCRIPTION OF A PREFERRED EMBODIMENT

Figure 1:
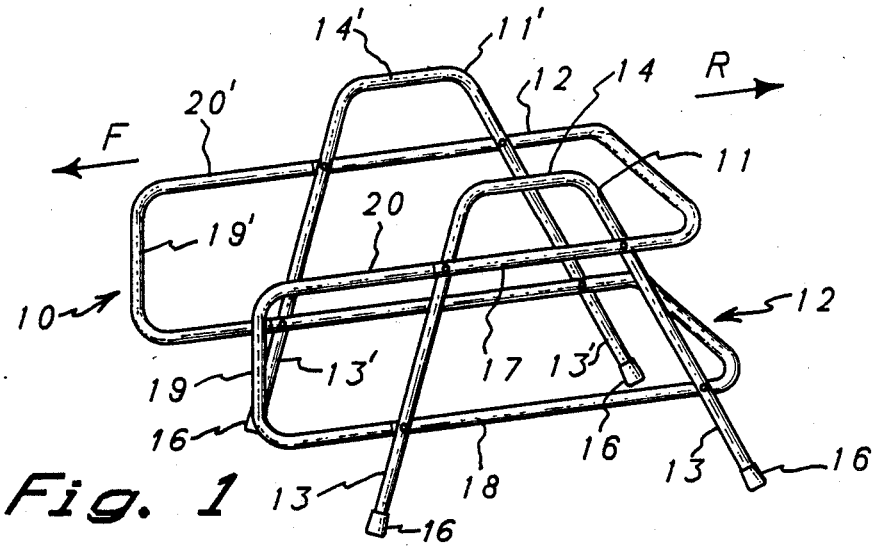
FIG. 1 is a schematic perspective view of the walker of this invention.

As illustrated in FIG. 1, walker 10 comprises a light weight open framework structure of, for example, tubular aluminum or synthetic resin. The frame-like structure is adapted to partly surround the user who is able to conveniently lift the walker and place it in a more forward position, which, for the purpose of this description, is denoted F in FIG. 1 to indicate the use of walker 10 in one selected forward or walking direction in a coordinated and systematic manner. Certain structural features are important and supportive of effective use of walker 10. As illustrated in FIG. 1, walker 10 comprises a pair of planar spaced apart side frame members 11 and 11' combined with and attached to an open grid girding frame 12. As illustrated in FIG. 1, side frame members 11 and 11' are conveniently formed from light weight tube sections in the form of an inverted truncated V shape so that the legs of the truncated V become the supporting pairs of legs 13 on one side of walker 10 and 13' on the opposite side, so that walker 10 includes four supporting legs with a front and rear leg on each side frame. The truncated sections 14 and 14' become convenient and centralized side hand rails for lifting and repositioning walker 10. The angularly directed legs of the inverted truncated V sections provide an advantageous span for walker 10 with the span distance between legs 13 and between legs 13' being significantly greater than the length of the truncated sections 14 and 14'. Pairs of legs 13 and 13' rest upon a supporting surface 15 (FIG. 2) such as a floor, walkway and the like, and suitable friction cups 16 are fitted to the ends of legs 13 and 13' to provide increased non-slip characteristics.

Side frame members 11 and 11' are positioned in spaced apart upright and converging relationship with each other, and are connected into a rigid structure by a girding frame 12. Girding frame 12 comprises a pair of parallel spaced apart upper and lower tube sections or rails 17 and 18, respectively, which are parallel to each other and spaced from base surface 15 as well as from side hand rails 14 and 14'. Rails 17 and 18 pass transversely across the plane of one side frame 11 engaging and bridging the pair of legs 13 of side frame 11. Rail 17 extends to project from legs 13 horizontally both in the F front and R rear directions as illustrated in FIG. 1, with the projection distance being significantly greater in the forward direction. In the R direction, rail section 17 turns or curves closely adjacent rear leg 13 to extend in a transverse direction towards opposite side frame 11' where it again cosely turns about leg 13' to pass across the plane of the opposite side frame 11' to engage and bridge legs 13' thereof.

Figure 2:
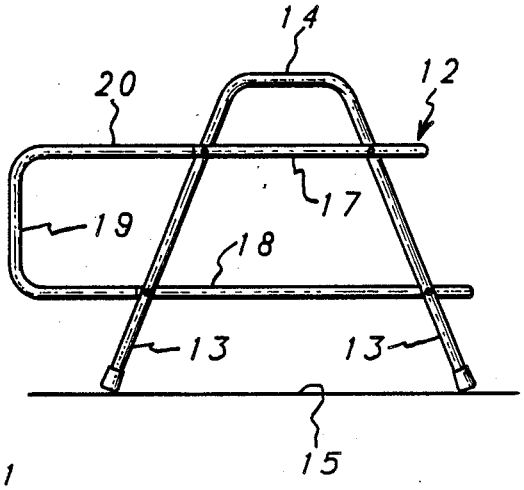
FIG. 2 is a schematic side elevation view of the walker of FIG. 1.
Figure 3:
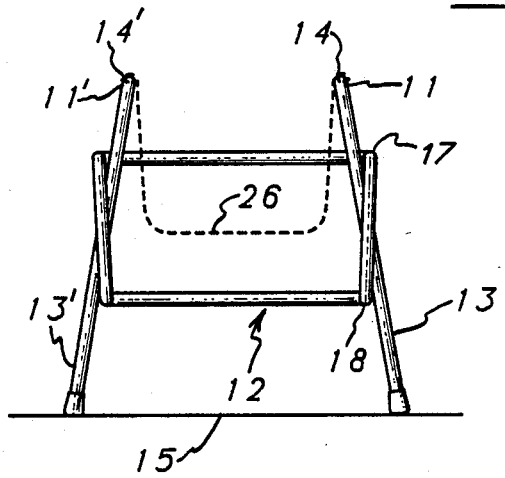
FIG. 3 is a schematic view of the walker of FIG. 2 of this invention taken along the line 3—3 thereof.

Preferably, as illustrated in FIGS. 1 and 2, girding frame 12 comprises a continuous tube section which is formed from, or as, a narrow rectangular closed loop and joins side frames 11 and 11' into a unitary frame walker 10 having a frontal F and rear R orientation, but which, in use, may be non-directional. Closed loop girding frame 12, as illustrated in FIGS. 1 and 3 may be described as comprising a pair of parallel side rails, upper rail 17 and lower rail 18, in the form of a long narrow rectangular closed loop which is transversely folded in a U shape so that the arms of the U shape are planar or fence-like in partly surrounding or encircling the user. Closed ends 19 and 19' of the loop extend horizontally (as shown in FIGS. 1 and 2) a significant distance from the front supporting leg of walker 10 to serve as forwardly extending hand rails 20 and 20'. Spaced apart parallel rails 17 and 18 represent planar side walls on opposite side of a user who is positioned between side frames 11 and 11' and within the U shaped girding grid 12 which is then described as a planar U, denoting a wall or fence concept of a girding grid. As illustrated in FIG. 1, spaced apart parallel rails 17 and 18 follow the angularity of the inverted truncated V frames 11 and 11' so that rail 18 passes transversely from one frame 11 to opposite frame 11' in a more rearwardly jutting position as compared to rail 17.

Referring now to FIG. 3, side frame members 11 and 11' are illustrated in side by side spaced apart relationship but angularly disposed with respect to each other, the spaced apart distance of opposite pairs of legs 13 and 13' at surface 15 being greater than the spaced apart distance of hand rails 14 and 14'. This angular relationship permits rails 17 and 18 of girding frame 12 to pass both inside and outside of inverted truncated V section frames 11 and 11'. As illustrated, rail 17 passes along the outside of frame 11 to bridge legs 13 and be rivet attached thereto while lower rail 18 passes along the inside of frame 11 to bridge legs 13 and be rivet attached thereto. The closed loop structure of girding frame 12 together with the interwining rivet arrangement increases the strength and integrity of walker 10 by permitting some imposed forces to be resisted by torsion and bending in the tubular structure rather than solely by rivets.

An important factor in the walker of this invention resides in the combination of the length of the U shaped girder from 12 (R to F, FIG. 1) and the distance between legs 13 of frame 11 and between legs 13' of frame 11'. These longer distances permit a user to take a larger step or more than one step while being fully supported in a balanced manner and before a need to reposition the walker arises. If the user of the walker of this invention may take two or three steps before a necessary repositioning of the walker, as compared to other walkers where only one step or half step could be so taken, then there will be a signficant reduction in expended walking energy with the walker of this invention. In other instances, the ability to transverse several steps before repositioning becomes necessary avoids some repetitious and undesirable repositioning. As illustrated in FIG. 2 for example, the distance between an opposed pair of front legs 13 and 13' and an opposed pair of rear legs 13 and 13' in one example of this invention was about 39 inches compared to a side hand rail section 14 of about 10 inches length. It is preferred that the forward span distance, i.e., the distance between front and rear legs be significantly greater than the lateral distance between a pair of front legs 13 and correspondingly between a pair of opposite rear legs 13'. In the latter instance, in one form of this invention, the noted lateral distance was about 23 inches compared to about 39 inches in forward span distance between legs on each frame 11 and 11'. The forward span distance may vary to some extend to conform to different stairs. However, in one present form of the invention, the forward span distance ranges from about 1.5 to about 1.7 times the lateral span distance.

Figure 4:
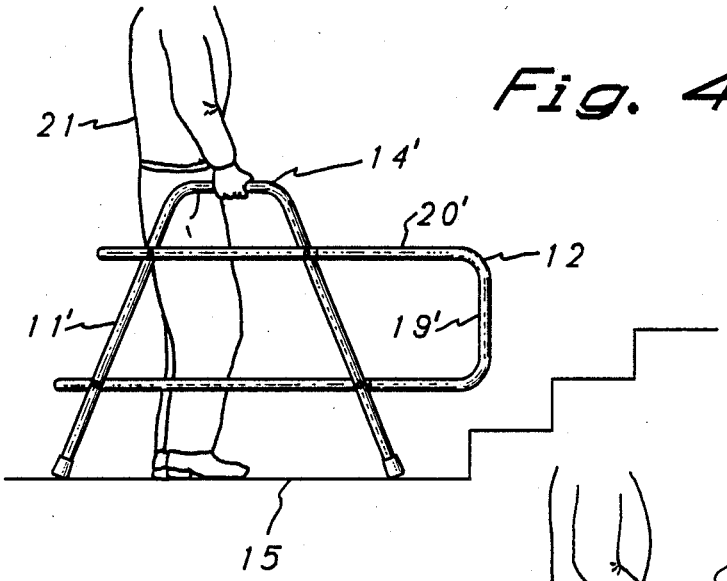
FIG. 4 is a schematic and perspective illustration of the walker of this invention being utilized on a level surface approaching a flight of stairs.

Walker 10 of this invention is most effective when the person using the walker is positioned in the defined space between frames 11 and 11' and within the confines of the U shaped girding frame 12 as illustrated in FIG. 4.

Referring now to FIG. 4, the body or torso 21 of a user person is positioned in the space between frames 11 (not shown) and 11' and within the arms of the U shaped girding frame 12 with hands grasping hand rails 14 (not shown) and 14' of side frames 11 and 11'. Hand rails 14 and 14' may be of oval cross section for more positive and comfortable gripping, and may also be covered with a soft and cushioning material for the same purposes. As illustrated in FIG. 4, user 21 may take several steps while remaining within the confines of walker 10 including the possibility of using forward rail extensions 20 and 20' in the event the user necessarily moves out of the space between frames 11 and 11'. In all instances the user has bilateral hand support from handles 14 and 14' and forward rails 20 and 20' available while walking, to provide a consistent and constantly available balancing support particularly when a user may be in between steps, e.g., when the total weight of the user may be on one leg. FIG. 4 also illustrates that a user may approach a stair or other object as closely as desired not only with an open channel to the object, but also with everpresent hand rails for support and lifting.

Figure 5:
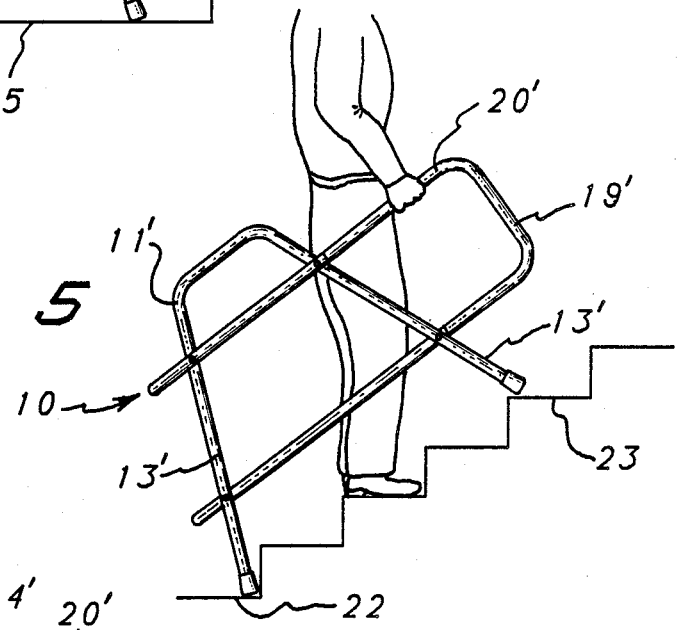
FIG. 5 is a schematic illustration of the walker of this invention being utilized on a stairway and spanning or bridging three steps.

The forward rail 20 and 20' of rail 17 become more important in connection with stair walking as illustrated in FIG. 5.

In FIG. 5, walker 10 is positioned so that legs 13 span multiple steps (e.g., 3 steps as shown). Rear leg 13' of side frame 11' rests upon the tread of the first step 22 while the front leg 13' of side frame 11' rests upon the tread of the 5th step 23 (in ascending order). This large multiple step span, taken in connection with the height of side rail 17 from the surface 15 of FIGS. 1-4, and the angle of elevation of standard stairways (about 30 degrees to 35 degrees) not only provides for the forward rail extension 20 and 20' to be positioned at a most convenient height and angle for the user during step to step ascending or descending, but also provides, in combination with the forward multiples step span distance, a very stable platform less likely to tilt or topple. There is also a sense of security gained by having the U shaped girding frame 12 surround the user on three sides. As illustrated in FIG. 5, the multiple step spanning walker of this invention permits the user to transverse more than one step before repositioning walker 10, and not only with constant and consistent hand support being available, but also being available at a predeterminedly advantageous elevation which enhances muscular effort for balancing and utilizes that muscular effort to impose downward forces on four large span legs to resist toppling.

The walker of this invention is particularly adaptable to overcome user problems with prior art walkers in making the transitions from starting at a level surface and beginning stair ascension, and ending stair ascension to walk on a level surface. Use of walker 10 in the latter transition is best shown in FIG. 6.

Figure 6:
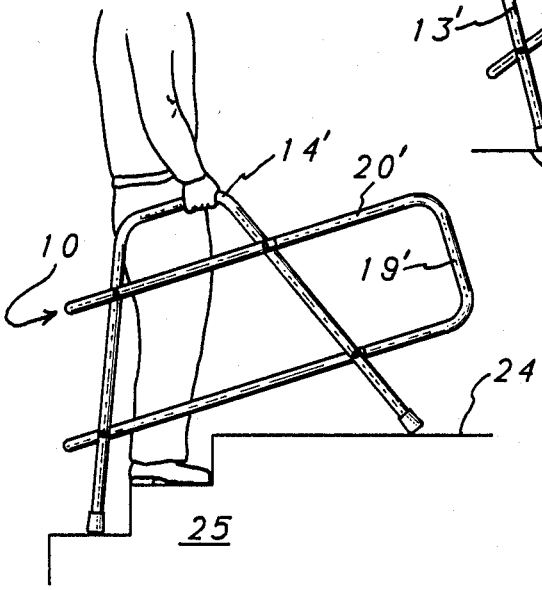
FIG. 6 is a schematic illustration of the walker of this invention being utilized on a stairway at the last upper step showing transition from ascending stairs to level walking.

Referring now to FIG. 6, near the top or landing 24 of stairs 25, the user repositions walker 10 from the FIG. 5 position to the FIG. 6 position. In this position, both handles 14 (not shown) and 14' and forward rail extensions 20 (not shown) and 20' are conveniently located to be grasped by the user's hands bilaterally. This feature, together with the noted forward span between legs 13 provides a very stable platform until the user is comfortably in a walking position on stair landing 24. All of the features and advantages as described with respect to stair ascension are equally available for stair descending as well as for walking along a level surface. In both instances the angle of incline of handles 14 and side rail extensions 20 (not shown) and 20' closely follow the slope angle of the stairs.

The spaced apart inverted truncated V shaped side frames, in combination with the intertwined projecting U shaped girder frame provides an improved high strength walking assistance and stair aid device.

In many instances the expended effort of walking may require some interim resting of the user. Resting is most desirable when it may be accomplished in a fully supported seating position and relatively close to the walker assisting device. However, with respect to some prior walking assistance devices, resting may require the user to remain in a standing, or a somewhat leaning position, and walkers with a narrow span between legs are easily toppled by leaning forces. The walker of this invention may be fitted with a seat rest which will not only permit restful seating in a convenient sitting position, but also permit the user of the walker to reamin within the walker. Furthermore, the seat rest is oriented to take advantage of the noted long forward span between legs 13 on one side of walker 10, and between legs 13' on the opposite side which, together with the weight and position of the user, provides a configuration very difficult to topple. Walker 10 equipped with a seat rest as described is also illustrated in FIG. 3.

Referring again to FIG. 3, walker 10 illustrates the intertwined structure of side frames 11 and 11' and U shaped girding frame 12. The inverted truncated V shaped and converging side frames 11 and 11' provide a pair of very convenient support means in the form of side handle rails 14 and 14'. A flexible material seat of, for example, a canvas material, leather or vinyl plastic is securely attached to side handle rails 14 and 14' (or alternatively, to side rails 17 and 17') to be suspended there between as a sling seat 26 (shown in phantom line).

A major advantage of sling seat 26 of this invention is that it is suspended in a direction generally transverse to side frames 11 and 11' so that the user faces the open end of the walker 10 in the forward or walking direction. This factor in combination with the wide span of legs 13 in the walking direction results in a combination having a desirable center of gravity and quite resistant to toppling forces. Moreover, side rails 17 and 18 of girding frame 12 extend transversely across the spaced apart side frames to be directly at the back of a person seated in sling seat 26 for added security and confidence.

This invention provides a much more improved structure for a walking assistance device in the form of spaced apart, long span leg supported side frames together with a generally U shaped girding grid. The arms or sides of the U shaped grid are intertwined with and attached to the side frames. A person using the walker takes a position between the side frames and in the U grid. A sling seat is supported between the side frames and within the U grid so that the base of the U grid is conveniently adjacent the back of the user when occupying the sling seat.

Figure 7:
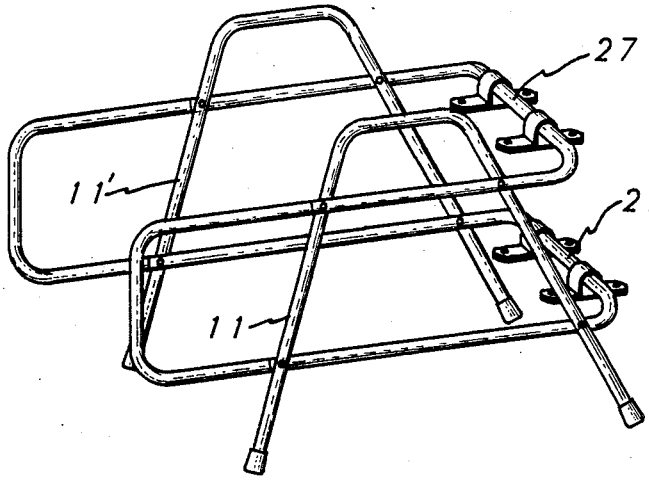
FIG. 7 is a schematic perspective view of the walker of this invention with pivoting means for folding the walker into a more compact form.

A further modification of the walker of this invention relates to transporting walker 10 either by the manufacturer, for shipping purposes, or by the user who may wish to transport the walker in a car trunk, for example, to a more distant location where the walker would be utilized. This transportation may be accomplished by means of public transportation such as motorized bus means in which the walker will be carried to the desired location. For these occasions, walker 10 may be adapted for folding into a more compact and easier to carry structure by providing separation means for girding frame 12 in the form of a pivoting hinge insert. For example, referring to FIG. 7, which is quite similar to FIG. 1, girding frame 12 is fitted with pivot means 27 and 27' which permits side frames 11 and 11' to be rotated and folded in a gate like manner each with respect to the other so that each side frame member will rest adjacent the other as shown in FIG. 8.

Figure 8:
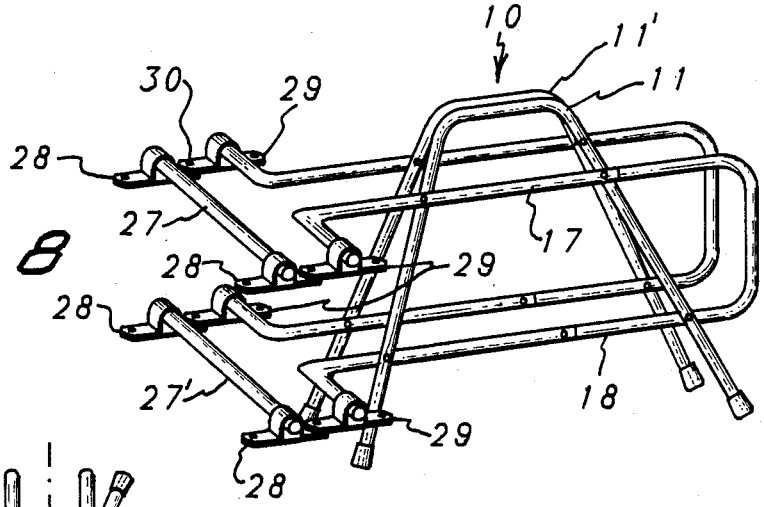
FIG. 8 is a schematic perspective view of the walker of this invention in a folded configuration.

Referring now to FIG. 8, walker 10 includes the side frames 11 and 11' of FIG. 1 resting adjacent each other, having been pivoted about pivot means 27 and 27' in each transverse section of parallel rails 17 and 18, respectively. Pivot means 27 and 27' may be described as an insert section for each rail 17 and 18 which have been separated along their transverse lengths to accommodate a pivot section 27 and 27'. A pivot section 27 and 27' may be described as a rail section which has been fitted with a pivot flange or hinge 28 at each end thereof. Correspondingly, the opposite ends of a girder frame rail 17 or 18 between which section 27 or 27' is inserted are also fitted with mating pivot flanges 29. Pivot flanges 28 and 29 are provided with oppositely positioned apertures which coincide when the flanges are in their FIG. 7 position and receive hinge or pivot pins 30 (only one shown in FIG. 8) therein. Hinge or pivot pins 30 are large and easily slidably withdrawn from their aperatures by the user of the walker. In the folding procedure a pivot pin must be withdrawn in order to actuate or effectuate the folding mechanism. When the appropriate pivot pins remain in their apertures the side frames 11 and 11' are locked in their unfolded position. Withdrawing both pivot pins is a prerequisite to the folding of a walker and is a safety feature against inadvertent folding or collapsing. When a corresponding sliding pin is withdrawn from opposite flanges, the remaining pair of pins serve as pivot pins for side frames 11 and 11' which may then be rotated 180 degrees about an insert section 27' for example, to lie closely adjacent each other in planar abutting relationship. In this folded position, walker 10 occupies a space having a width about equal to the length of the longer insert pivot section 27' which is about 12.5 inches. The folding and pivoting configuration and the occupied small space are clearly shown in FIG. 9.

Figure 9:
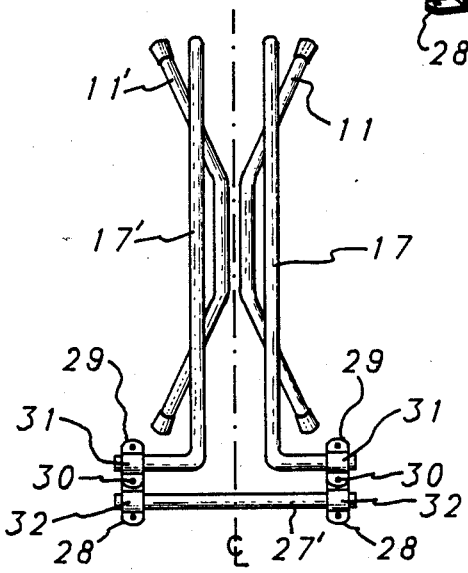
FIG. 9 is a schematic and top view of the walker of FIG. 8 illustrating compactness after folding.

Referring now to FIG. 9, walker 10 is illustrated in a top view with side frames 11 and 11' in planar abutting relationship to each other after pivoting about pivot pin 30 in the flanges 28 and 29 of insert pivot section 27' (27 not shown). The compact folded structure as above noted includes a maximum thickness represented by the length of insert pivot section 27' which is about 12.5 inches in length. Flanges or hinges 28 and 29 are appropriately formed so that, in folding from their folded position (FIG. 9), for example, to their unfolded position (FIG. 7), for example, ends 31 of side rails 17 and 18 (not shown) are in abutting and concentric relationship. In this connection, in order to strengthen the structure at the end joints, where tube ends abut, one tube end may be fitted with a projecting polygon cross-section protruding tapered pin while the opposed tube end includes a corresponding polygon cross-section tapered aperture. In unfolding walker 10 from the FIG. 8 or FIG. 9 configuration to the FIG. 1 or FIG. 7 configuration, the tapered pin will slide into the tapered aperture of insert 27', for example, for increased torsion and bending resistance at the tube junctures. A further transverse pin may pass through appropriate apertures in the insert and with the noted protruding pin to securely lock it in position and be a safety lock to prevent inadvertant folding of walker 10.

The flexible material sling seat 26 of FIG. 3 may be attached to hand rails 14 and 14' by appropriate releasably securing means such as the well known snap fasteners. One side of sling seat 26 must be released before folding walker 10. As a further convenience to the user those pins in flanges 28 and 29 which are intended to be removed prior to folding may be conveniently attached to a large ring or string for quick and positive identification and grasping. Walker 10 of this invention, as illustrated in FIGS. 1–6, is not only conveniently useful as a walking assistance device, but also is specifically adaptable for ascending and descending stairs including the associated walking transitions from a level surface to a stairway ascending or descending. Walker 10 is defined as an open end encircling framework supported by a pair of front legs 13 and 13' and an opposite pair of rear legs 13 and 13'. The open end, for example, the U shaped girding frame, permmits easy access and exit of the user to the appropriate user position within the side frames. The girding frame encircles the user except for the open end for access and egress. The four support legs are arranged to have a significant forward span distance between the front legs and the rear legs, e.g., capable of spanning multiple steps in a stairway, and, in combination, a wide lateral span or stance to provide positive and effective stability. Additionally, part of the framework extends horizontally forward for extended handrails (20 and 20', FIGS. 1–6). The extended handrails are adapted to be at a convenient height and to assume a comfortable angle when the walker is used on stairs. This comfortable angle approximates the angle of rise or descent of the stairs.

Walker 10 as illustrated in FIGS. 1–6 indicates one preferred use with the open end of the walker facing in the forward direction of movement of the user. FIGS. 4, 5 and 6 specifically. However, F front and R rear are terms of convenience in this description since walker 10 may be advantageously employed with the closed end in the forward position on a horizontal surface or on stairways.

While this invention has been illustrated and described with respect to preferred embodiments, it will be understood by those skilled in the art that various changes and modifications may be made therein without departing from the spirit and scope of the invention as set forth in the following claims.

What is claimed is:

1. A walking assistance device particularly adapted to assisting a user in ascending or descending a stairway having a plurality of steps, said device comprising in combination:

(a) a light weight easily portable open end encircling framework;

(b) said framework having a pair of front leg supports spaced by a first lateral distance and a pair of rear leg supports spaced by a second lateral distance;

(c) a part of said frame defining a first set of parallel spaced apart side handrails for the user of said device to grasp when said device is on a substantially flat surface;

(d) a further part of said frame projecting in the open end direction of said framework such that a second set of parallel spaced apart handrails is provided, said second set of handrails being vertically lower than said first set of handrails, said second set of handrails being sized and located for the user of said device to grasp when ascending or descending the stairway;

(e) said pair of front legs being spaced from said pair of rear legs such that said device spans at least three steps when used to ascend or descend the stairway; and (f) said open end framework provides continuous support by encircling the user of said device on three sides when in use on a flat surface or a stairway.

2. The invention as recited in claim 1 wherein folding means are incorporated in said frame to fold said frame into a folded structure having markedly reduced dimensions as compared to its unfolded dimensions.

3. The invention as recited in claim 1 wherein a flexible material sling seat 26 is releasably secured to said side hand rails to be suspended therefrom and seat the user of said device therein.

4. The invention as recited in claim 1 wherein said first lateral distance and said second lateral distance are approximately equal and the at least three step span distance between said front and rear leg supports is greater than the lateral distance between said pairs of leg supports.

5. The invention as recited in claim 4 wherein said at least three step span difference between said front and rear leg supports is 1.5 to 1.7 times greater than the lateral distance between said pairs of front and back leg supports.

6. The invention as recited in claim 1 wherein said device is constructed to span at least four steps when used to ascend or descend the stairway.

7. The invention as recited in claim 1 wherein said open end framework includes a transverse section which connects a first side of the framework having one of said front leg supports and one of said rear leg supports with a second side of said framework, said second side having the other of said front leg supports and the other of said rear legs supports, and wherein the device further includes pivot means in the transverse section between said first and second side frame members to pivot said side frames into planar abutting relationship to each other.

8. The invention as recited in claim 7 wherein said pivot means includes a user retractable lock means to actuate said pivot means.

* * * * *